United States Patent [19]

Shabazz

[11] Patent Number: 4,662,082

[45] Date of Patent: May 5, 1987

[54] SHOE SAVER

[76] Inventor: Rasheed A. Shabazz, 201-08 115 Ave., St. Albans, N.Y. 11412

[21] Appl. No.: 726,039

[22] Filed: Apr. 22, 1985

[51] Int. Cl.[4] ..... A43B 13/22

[52] U.S. Cl. ..... 36/72 B; 36/72 R

[58] Field of Search ..... 36/72 B, 72 R; D2/271, D2/277

[56] References Cited

U.S. PATENT DOCUMENTS

| | | | |
|---|---|---|---|
| 1,417,934 | 5/1922 | Miller | 36/72 B |
| 3,006,427 | 12/1962 | Matthews | 36/72 B |
| 3,187,446 | 6/1965 | Boudemann | 36/72 B |
| 3,217,430 | 11/1965 | Novick | 36/72 B |
| 3,983,641 | 10/1976 | Wright | 36/72 B |
| 4,498,252 | 2/1985 | Connors | 36/72 B |

FOREIGN PATENT DOCUMENTS

| | | | |
|---|---|---|---|
| 3140289 | 4/1983 | Fed. Rep. of Germany | 36/72 B |
| 620851 | 4/1927 | France | 36/72 B |
| 643940 | 9/1928 | France | 36/72 B |
| 2250268 | 5/1975 | France | 36/72 R |
| 2126871 | 4/1984 | United Kingdom | 36/72 B |
| 2142813 | 1/1985 | United Kingdom | 36/72 B |

*Primary Examiner*—Werner H. Schroeder
*Assistdnt Examiner*—Steven N. Meyers
*Attorney, Agent, or Firm*—Richard L. Miller

[57] ABSTRACT

This invention is a shield for a lower rear end of a shoe and includes a plastic main body contoured to the shoe shape, and a strap for securing the shield to the shoe.

1 Claim, 4 Drawing Figures

SHOE SAVER

BACKGROUND OF THE INVENTION

This invention relates generally to shoe accessories. More specifically it relates to shoe shields that protect shoes from becoming scuffed.

It is well known to most motorists that their right shoe becomes scuffed in time with worn mark in the vicinity just above the heel. This is caused by resting the rear edge of the shoe heel on a mat or floor of the car while shifting the foot side to side between the accelerator pedal and the brake pedal. To persons who are fastidious about their personal appearance, such shoe is unsightly so that it is objectionable for further wear in public. Replacement of a pair of shoes for such reason can be expensive, so that this situation is accordingly in need of an improvement.

Therefore it is a principal object of the present invention to provide a shoe saving device that can be worn around the shoe during driving, and which shields the shoe from becoming scuffed as a person shifts his foot between the pedals.

Another object is to provide a shoe saver which is adaptable to fit either a man's shoe or a woman's shoe, and is adjustable as well as being quick and easy to install or remove.

Yet another object is to provide a shoe saver which is not at all unpleasant in appearance if momentarily left on the shoe while a motorist steps from the vehicle into a store, coffee shop or the like.

Other objects are to provide a shoe saver which is simple in design, easy to manufacture, and efficient in operative use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
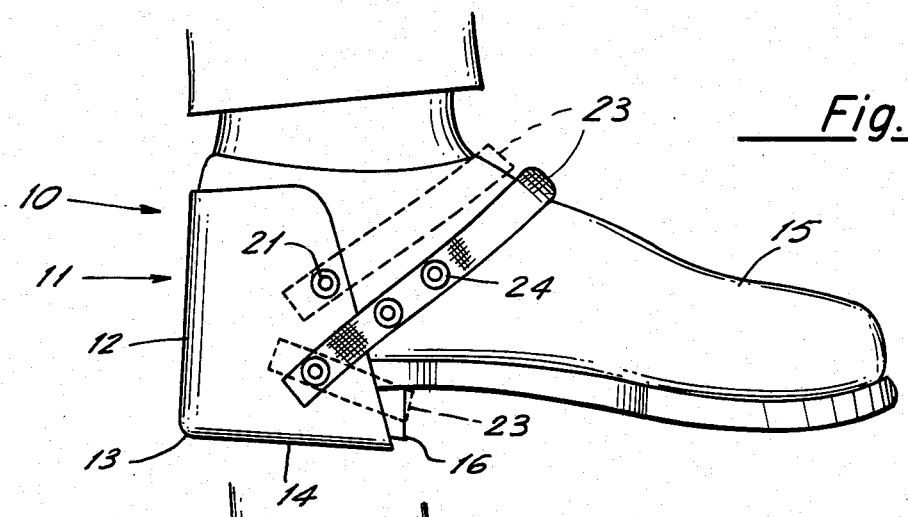
FIG. 1 is a side view of the invention illustrated in use on a man's shoe.

Referring now to the Drawing in greater detail, the reference numeral 10 represents a shoe saver according to the present invention, wherein there is a main body member 11 molded from a semi-soft plastic material, and which is contoured to fit around a lower rear end of a shoe. Accordingly it includes an upright rear wall portion 12 that extends at each opposite side end in order to wrap around a part of each side of the shoe. The lower edge 13 of the rear wall portion is gently rounded where it forms also an edge of a bottom wall portion 14. When fitted on a man's shoe 15, the shoe heel 16 rests on top of the bottom wall portion. When a woman's shoe has a wide heel similarly to a man's shoe, the heel then also rests upon the bottom wall portion. However if she is wearing shoes 17 having spike heels 18, the spike inserted through a central opening 19 in the bottom wall portion so that the bottom wall portion around the opening 19 is continuous and fits against an underside of the shoe upper 20 and sole in front of the spike heel 18.

Figure 2:
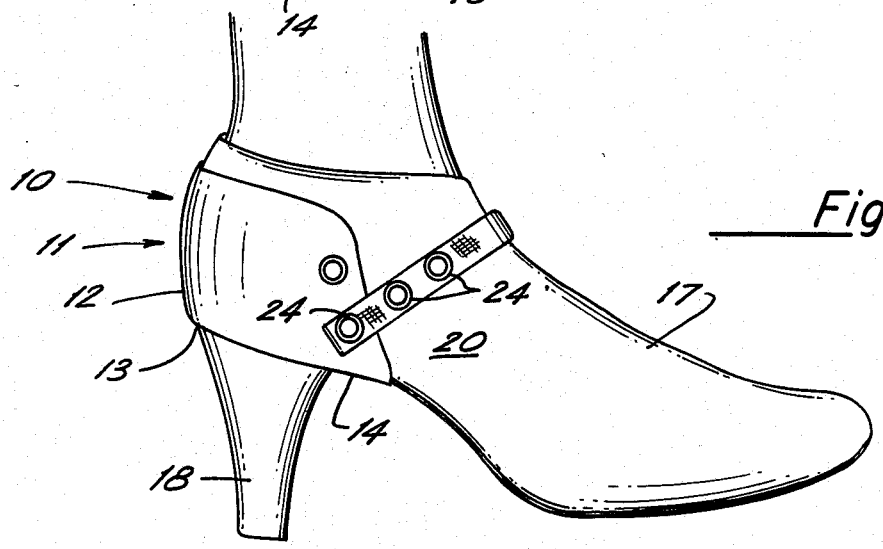
FIG. 2 is a side view of the invention illustrated in use on a woman's shoe.
Figure 3:
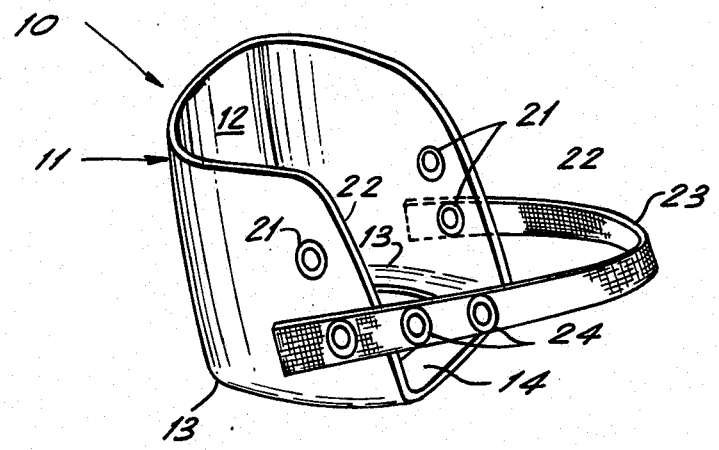
FIG. 3 is a perspective view of the invention per se.

A pair of snap fastener buttons 21 affixed near each side edge 22 of the rear wall portion 12, and an elastic band member 23, having a plurality of snap fastener buttons 24 riveted along its length, is selectively affixed to the buttons 21 while the band adjustable extends around a front of the shoe, as best shown in FIGS. 1 and 2. Additionally a band may be fitted around a front edge of the heel, as shown in FIG. 1.

Figure 4:
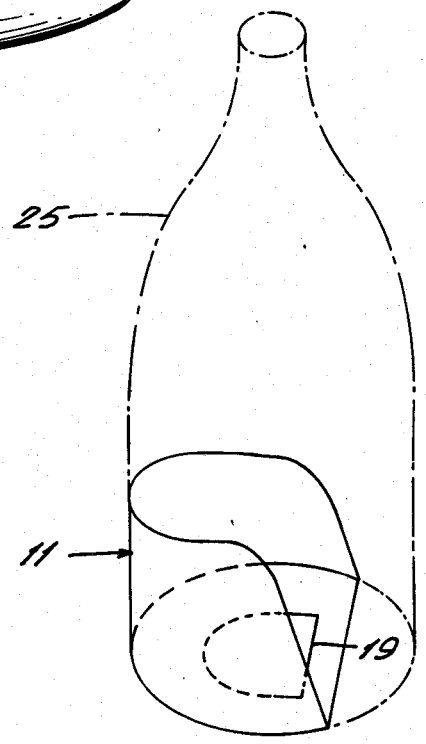
FIG. 4 is a diagrammatic perspective view of a bottle showing how the invention is fabricated therefrom.

The main body member may be cut out of a plastic bottle 25, during its manufacture, as suggested in FIG. 4.

In use, the shoe saver shields the shoe surface from frictional rubbing so as to prevent scuffs from developing.

While certain novel features of this invention have been shown and described and are pointed out in the annexed claims, it will be understtod that various ommissions, substitutions and changes in the forms and details of the device illustrated and in its operation can be made by those skilled in the art without departing from the spirit of the invention.

What is claimed is:

1. A shoe saver, comprising, in combination, a main body member for fitting around a rear lower end of a motorist's shoe, and an elastic strap member adjustably attached to said main body member for securement around the front of said shoe, said main body member comprising an upright rear wall portion being U-shaped in cross section for fitting around the back part of the shoe, and a flat bottom wall portion horizontally supported by the rear wall portion in a horizontal orientation for retaining thereon a wide heel of a shoe, means defining an opening in said horizontal bottom wall portion for passage therethrough of a spike heel, the portion of the bottom wall portion around the opeing is continuous and completely surrounds the opening for fitting against an underside of a shoe upper and sole around and in front of the spike heel, snap fasteners formed near the side edges of the rear wall portion, and a plurality of mating snap fasteners provided along the length of the strap member for selective coupling to the rear wall portion.

* * * * *